US011420316B2

(12) United States Patent
Liang et al.

(10) Patent No.: US 11,420,316 B2
(45) Date of Patent: Aug. 23, 2022

(54) SYSTEMS AND METHODS FOR A MULTI-TOOL MONEY CLIP

(71) Applicant: NITE IZE, INC., Boulder, CO (US)

(72) Inventors: Robin Liang, Guandong (CN); Andrew Valentine, Wheat Ridge, CO (US); Bowden Ormsbee, Longmont, CO (US); Rex Stevens, Longmont, CO (US)

(73) Assignee: Nite Ize, Inc., Boulder, CO (US)

( * ) Notice: Subject to any disclaimer, the term of this patent is extended or adjusted under 35 U.S.C. 154(b) by 590 days.

(21) Appl. No.: 16/003,851

(22) Filed: Jun. 8, 2018

(65) Prior Publication Data

US 2019/0375087 A1 Dec. 12, 2019

(51) Int. Cl.

| | |
|---|---|
| ***B25F 1/04*** | (2006.01) |
| ***B25B 15/00*** | (2006.01) |
| ***A45C 1/06*** | (2006.01) |
| ***B67B 7/16*** | (2006.01) |
| ***B67B 7/44*** | (2006.01) |
| ***B67B 7/46*** | (2006.01) |
| ***A45C 15/00*** | (2006.01) |
| ***B26B 11/00*** | (2006.01) |

(52) U.S. Cl.

CPC ..... *B25F 1/04* (2013.01); *A45C 1/06* (2013.01); *A45C 15/00* (2013.01); *B25B 15/005* (2013.01); *B25B 15/007* (2013.01); *B26B 11/001* (2013.01); *B67B 7/16* (2013.01); *B67B 7/30* (2013.01); *B67B 7/44* (2013.01); *A45C 2001/062* (2013.01); *B67B 2007/303* (2013.01)

(58) Field of Classification Search

CPC ... B25F 1/04; A45C 1/06; A45C 1/062; A45C 1/065; A45C 15/00; A45C 2001/062; B25B 15/005; B25B 15/007; B26B 11/001; B67B 7/16; B67B 7/30; B67B 7/44; B67B 2007/303

USPC ..... 7/118, 167, 168, 165, 151

See application file for complete search history.

(56) References Cited

U.S. PATENT DOCUMENTS 1,206,074 A * 11/1916 Zwiener ..... A45F 5/02 24/3.6
3,027,995 A * 4/1962 Littman ..... A45C 1/02 206/0.81
3,203,402 A * 8/1965 Lockwood ..... B43K 24/082 235/78 R (Continued)

*Primary Examiner* — Monica S Carter
*Assistant Examiner* — Marcel T Dion
(74) *Attorney, Agent, or Firm* — Haynes and Boone, LLP

(57) ABSTRACT

A multifunction money clip includes a first plate and a second plate connected to the first plate via a plurality of connectors at the corners of the first and second plate, the first and second plate forming an internal area. The multifunction money clip further includes a plurality of tools each rotationally connected to the first and second plate via one of the plurality of connectors, the plurality of tools located in the internal area when retracted. The multifunction money clip further includes a double clip located on the first plate, a first portion of the double clip opening in a first direction and configured to trap items between the first plate and the clip and a second portion of the double clip opening in a second direction, opposite the first direction, and configured to trap items between the second clip portion and the first clip portion. A small clip is included opposite the double clip to attach to a pocket.

20 Claims, 7 Drawing Sheets

(56) References Cited

U.S. PATENT DOCUMENTS 3,861,002 A * 1/1975 Gordon ..... A45C 1/06 24/336
4,238,862 A * 12/1980 Leatherman ..... B25B 7/22 7/128
4,705,086 A * 11/1987 O'Neill ..... A45C 1/04 150/134
4,717,275 A * 1/1988 Burkhardt, Jr. ..... B43K 25/028 401/84
4,784,199 A * 11/1988 Wise ..... A45C 1/08 150/134
4,903,745 A * 2/1990 Roman ..... A45C 1/04 150/134
5,697,127 A * 12/1997 Tyler ..... A45C 1/06 206/69
7,051,627 B2 * 5/2006 Rivera ..... B25F 1/003 7/128
7,347,325 B2 * 3/2008 O'Neill ..... A45C 1/06 206/38
7,634,956 B2 * 12/2009 Rivera ..... B25F 1/003 7/118
8,887,598 B1 * 11/2014 Oakley ..... B26B 11/001 81/3.09
10,265,874 B1 * 4/2019 Morgan ..... B25F 1/04
2004/0003472 A1 * 1/2004 Dallas ..... B25F 1/003 7/128
2004/0083552 A1 * 5/2004 Abrahall ..... B67B 7/44 7/151
2005/0150333 A1 * 7/2005 Rivera ..... B25B 23/0035 81/450
2008/0178976 A1 * 7/2008 Lakhiani ..... A45C 1/06 150/137
2010/0122420 A1 * 5/2010 Nason ..... B25F 1/04 7/128
2011/0277892 A1 * 11/2011 Black ..... A45C 1/06 150/148
2013/0061990 A1 * 3/2013 Syma ..... A45C 11/182 150/137
2014/0082850 A1 * 3/2014 Stokes ..... B25F 1/04 7/108
2015/0059937 A1 * 3/2015 Singer ..... A45C 11/32 150/147
2015/0115008 A1 * 4/2015 Griffith ..... A45F 5/021 224/269
2015/0320190 A1 * 11/2015 Gaudet ..... A45F 5/021 24/3.12
2017/0019512 A1 * 1/2017 Guerdrum ..... A45F 5/00
2017/0265610 A1 * 9/2017 Smith, II ..... B29C 51/08
2017/0273446 A1 * 9/2017 Zentil ..... B25F 1/04
2018/0027935 A1 * 2/2018 Laatz ..... A45C 11/182
2018/0332936 A1 * 11/2018 Serman ..... A45C 11/182
2019/0313778 A1 * 10/2019 Beckage ..... A45C 13/1069
2020/0077758 A1 * 3/2020 Hoffman ..... A45C 11/182

* cited by examiner

SYSTEMS AND METHODS FOR A MULTI-TOOL MONEY CLIP

BACKGROUND

In numerous scenarios it is desirable to have various tools for a user, without having to account for and carry such tools. Numerous small tools exist for consumers including Swiss army knives and multi-tools. One disadvantage of such devices is that the user must carry the device in addition to a wallet, smart phone, keys, or other items commonly held in one's pockets. Additionally, a consumer may forget to put such a device in their pocket and therefore be deprived of the device when in need.

BRIEF SUMMARY

In one embodiment, a multifunction money clip includes a thin plate body portion having an internal area. The multifunction money clip further includes a plurality of rotationally extendable tools, located in the internal area. The multifunction money clip further includes a clip attached to the thin plate body portion, the clip located such that the clip is configured to trap items between the thin plate body portion and the clip. In one alternative, the clip includes a double clip, a first portion of the double clip opening in a first direction and a second portion of the double clip opening in a second direction, opposite the first direction, and configured to trap items between the second clip portion and the first clip portion. In another alternative, the first portion of the double clip is located nearer to the thin plate body portion than the second portion of the double clip. Alternatively, the first portion of the double clip has upturned ends forming an incline for the insertion items. Optionally, the multifunction money clip further includes a small clip, the small clip located on a first side of the thin plate body portion and the clip is located on a second side of the thin plate body. Alternatively, the plurality of rotationally extendable tools includes a box opener tool, a can opener tool, and a bottle opener tool. In another alternative, the can opener tool includes a narrowed Philips head screw driver at an end. Alternatively, the bottle opener tool includes a narrowed flat head screw driver at an end. Optionally, comprising an internal frame located in the internal area. In another alternative, the internal frame includes a stop for preventing the over-rotation of at least one of the plurality of rotationally extendable tools. In another alternative, the multifunction money clip further includes a double spring, the double spring oriented in the internal area such that the double spring interacts with at least two of the plurality of rotationally extendable tools, preventing the at least two of the plurality of rotationally extendable tools from extending. In another alternative, the multifunction money clip further includes a small clip spacer, the small clip spacer oriented in an aperture in the internal frame, the small clip spacer positioned to assist the small clip to extend from the thin plate body portion and hold the small clip to the thin plate body portion. Optionally, the box opener includes a hooked end and a notch positioned and configured to rest against the stop when the box opener is extended. Alternatively, the can opener and the bottle opener are on a first widthwise side of the thin plate body portion and the box opener is on a second widthwise side of the thin plate body portion. In another alternative, the thin plate body portion is between 2 and 5 millimeters thick. Optionally, the plurality of rotationally-extendable tools are each connected to the thin plate body portion via one of a plurality of pivot points. Alternatively, the plurality of pivot points hold a first plate side and a second plate side of the thin plate body portion together and the plurality of pivot points are located proximate to the corners of the thin plate body portion.

In one embodiment, a multifunction money clip includes a first plate and a second plate connected to the first plate via a plurality of connectors at the corners of the first and second plate, the first and second plate forming an internal area. The multifunction money clip further includes a plurality of tools each rotationally connected to the first and second plate via one of the plurality of connectors, the plurality of tools located in the internal area when retracted. The multifunction money clip further includes a double clip located on the first plate, a first portion of the double clip opening in a first direction and configured to trap items between the first plate and the clip and a second portion of the double clip opening in a second direction, opposite the first direction, and configured to trap items between the second clip portion and the first clip portion. Alternatively, the plurality of tools includes a box opener tool, a can opener tool, and a bottle opener tool.

In one embodiment, method of using a multifunction money clip includes providing a multifunction money clip including a first plate and a second plate connected to the first plate via a plurality of connectors at the corners of the first and second plate, the first and second plate forming an internal area. The multifunction money clip further includes a plurality of tools each rotationally connected to the first and second plate via one of the plurality of connectors, the plurality of tools located in the internal area when retracted. The multifunction money clip further includes a double clip located on the first plate, a first portion of the double clip opening in a first direction and configured to trap items between the first plate and the clip and a second portion of the double clip opening in a second direction, opposite the first direction, and configured to trap items between the second clip portion and the first clip portion. The method further includes placing at least one item selected from a card and money in the first portion of the double clip. The method further includes attaching the multifunction money clip to an article of clothing using a small clip attached to the second plate. The method further includes detaching the multifunction money clip from the article of clothing. The method further includes extending at least one of the plurality of tools from the multifunction money clip.

DETAILED DESCRIPTION

Certain terminology is used herein for convenience only and is not to be taken as a limitation on the embodiments of the systems and methods for multi-tool money clip. Various embodiments of a multi-tool money clip include a body portion housing various retractable tools and a money clip on a flat face of the body portion. In many embodiments, the retractable tools include a can opener, a bottle opener, and a box opener. In many embodiments, the device includes a pocket clip.

Figure 1:
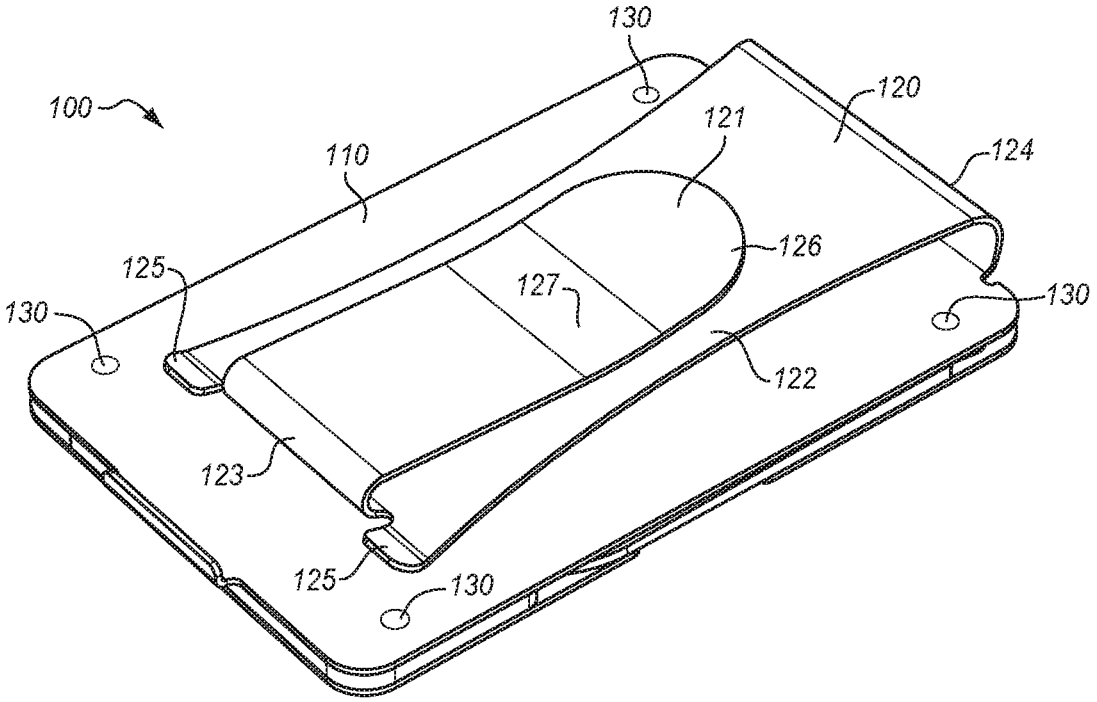
FIG. 1 shows one embodiment a perspective top view of a multi-tool money clip.

FIG. 1 shows one embodiment a perspective top view of a multi-tool money clip 100. Multi-tool money clip 100 includes a rectangular body 110. On the face of body 110 a clip 120 is mounted. Clip 120 has two clip portions 121, 122 that may use spring tension to trap clothing, cash, or credit cards. Clip portion 121 is defined by bend 123. In many embodiments, clip portion 121 is designed to hold cash. In some embodiments, clip portion 121 is generally designed and configured to be placed on a pocket of the pants of a user and has sufficient spring tension for such a purpose. Clip portion 121 is designed to hold money. Alternatively, clip portion 121 traps the fabric of a pocket between clip portion 121 and the face of clip portion 122. Clip portion 121 may be omitted in some alternatives. Clip portion 122 is defined by bend 124 and is generally designed and configured to hold credit cards, money, or other card shaped items. Generally clip portion 122 has sufficient spring tension for this purpose. Clip portion 122 traps the money and credit cards between it and the face of rectangular body 110. Rectangular body 110 generally has the shape of a credit card or similar thereto, although in alternatives, other shapes may be utilized. Clip portion 122 includes incline bends 125, which provide for an advantageous incline for the insertion of cards under clip 122. Similarly, the end 126 of clip portion 121 may bend slightly upwards to aid in the insertion of clothing between clip portion 121 and clip portion 122. Rivets 130 are also visible in this view and are used to hold the device together and provide for the extension of various tools in a rotational fashion. In many embodiments, the multi-tool money clip 100 in made of metal, such as steel or aluminum. The particular configurations shown may have very narrow depths, the depth being between 1-5 mm and in many configurations approximately 3 mm.

Figure 2:
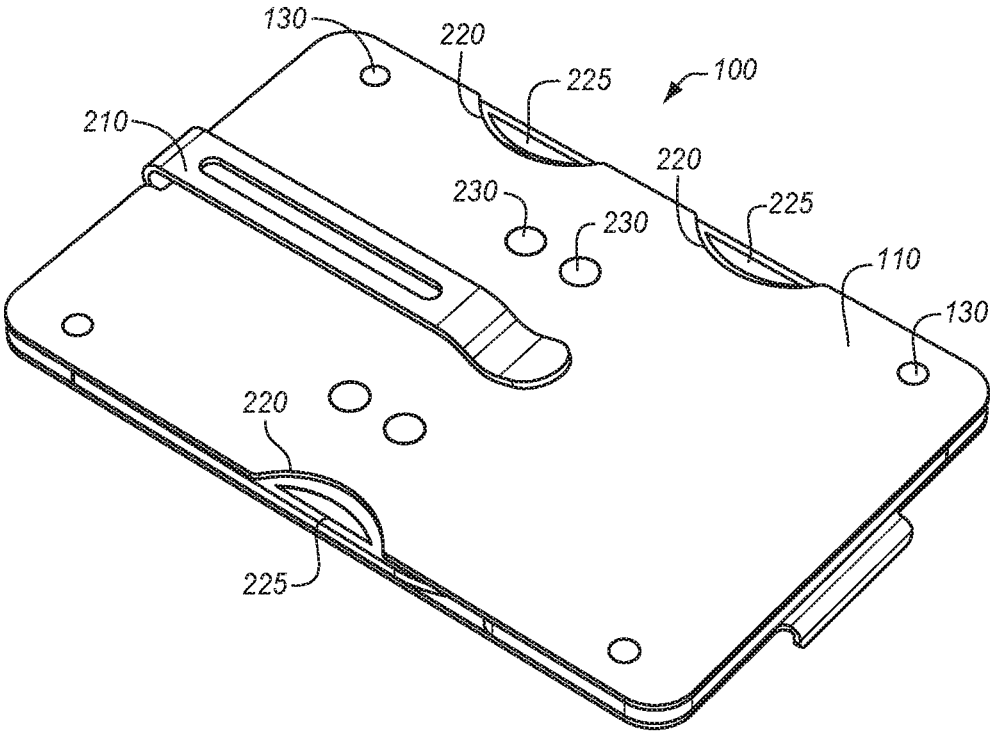
FIG. 2 shows a perspective bottom view of the multi-tool money clip of FIG. 1.

FIG. 2 shows a perspective bottom view of multi-tool money clip 100. The underside of body 110 is visible. Additionally, rivets 130 are shown in an underside view. A pocket clip 210 is visible in this view. Pocket clip 210 is extendable from the body 110 as will later be explained. Pocket clip 210 provides for an alternative clipping arrangement, as may be utilized in pocket. The clip extends away from the device such that the multi-tool money clip 100 may sit low in the pocket. The extension device for this is described below. Cutaways 220 reveal nail pulls 225 in each of the tools of the device. In this fashion the user may find a pull point for the extension of the tools of the device. Also shown are rivets 230, which provide for the holding of the spring arms that hold the tools of the device in a retracted or extended position.

Figure 3:
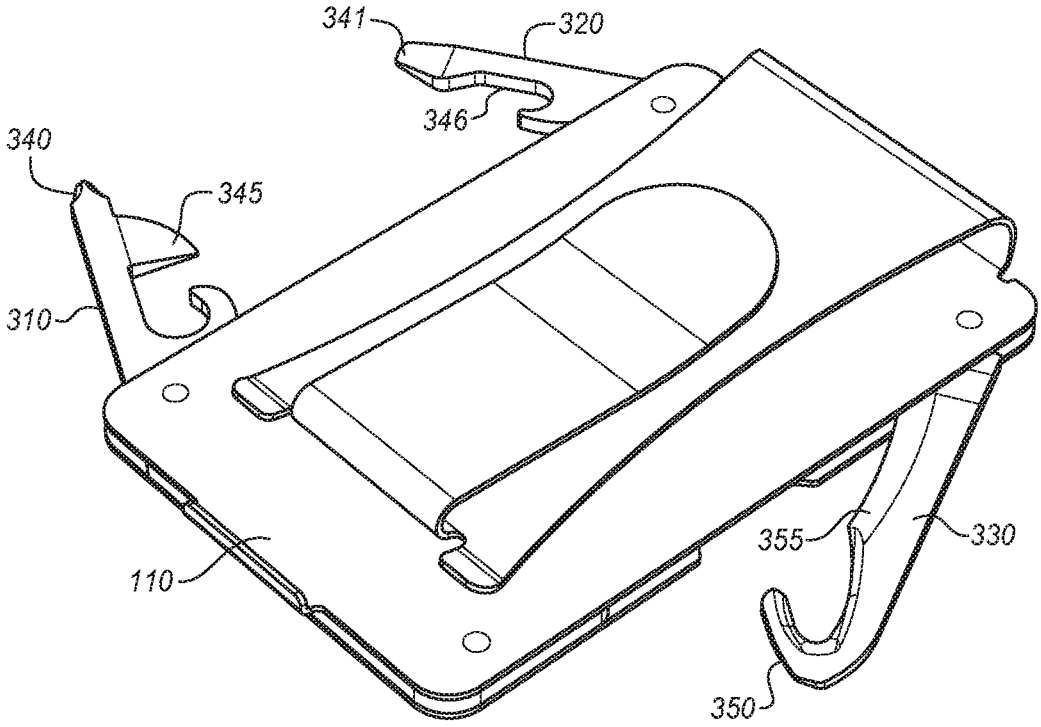
FIG. 3 shows a perspective top view of the multi-tool money clip of FIG. 1 with the tools extended.

FIG. 3 shows perspective top view of a multi-tool money clip 100 with the tools partially extended. Can opener 310 includes a opener section 345 and a Philips head screw driver section 340. Bottle opener 320 includes bottle opener section 346 and flathead screw driver section 341. Box opener 330 includes hook section 350, which may include a sharpened edge for cutting boxes open. In some embodiments area 355 is also sharpened or edged and may be used as a cutting device.

Figure 4:
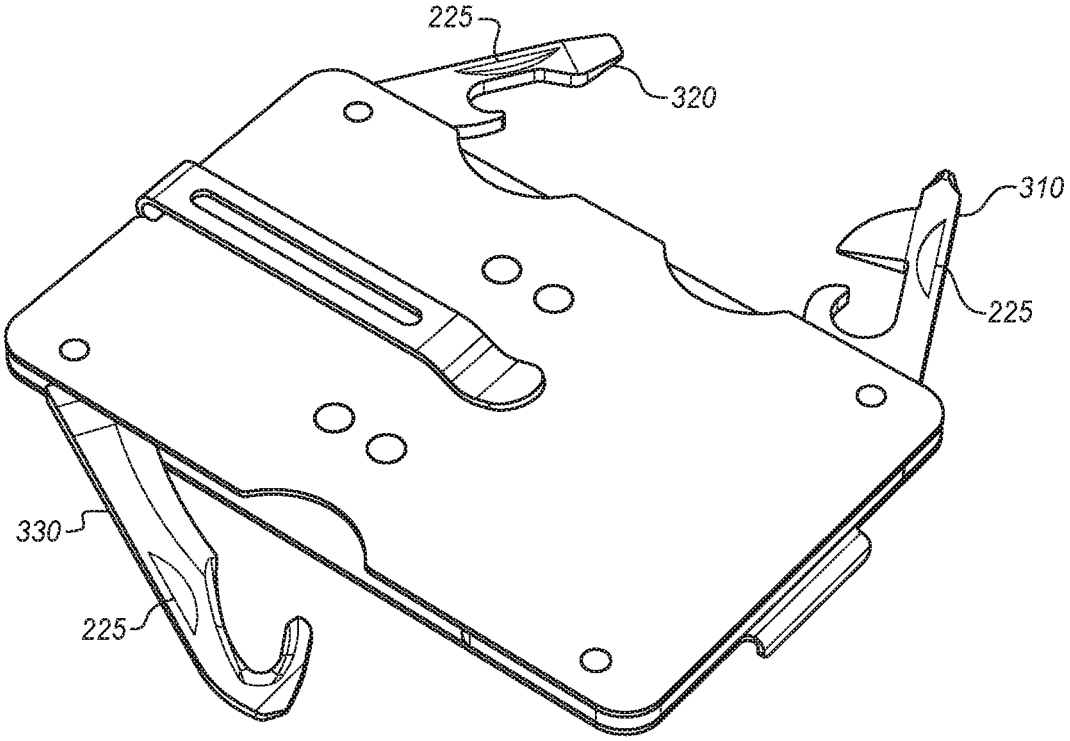
FIG. 4 shows a perspective bottom view of the multi-tool money clip of FIG. 1 with the tools extended.
Figure 5:
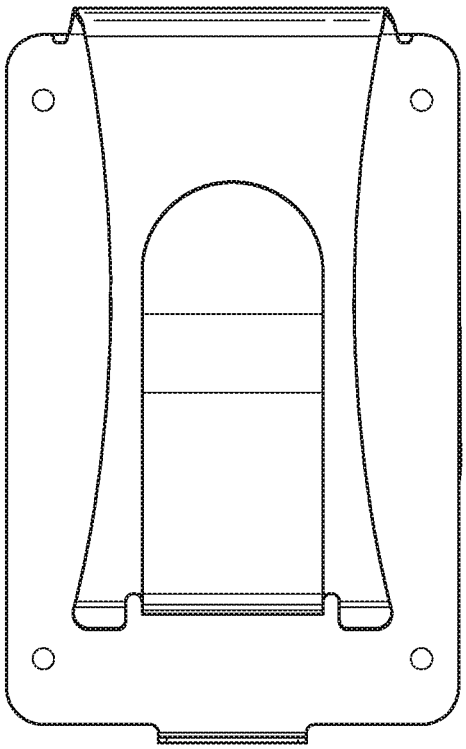
FIG. 5 shows a top view of the multi-tool money clip of FIG. 1.
Figure 6:
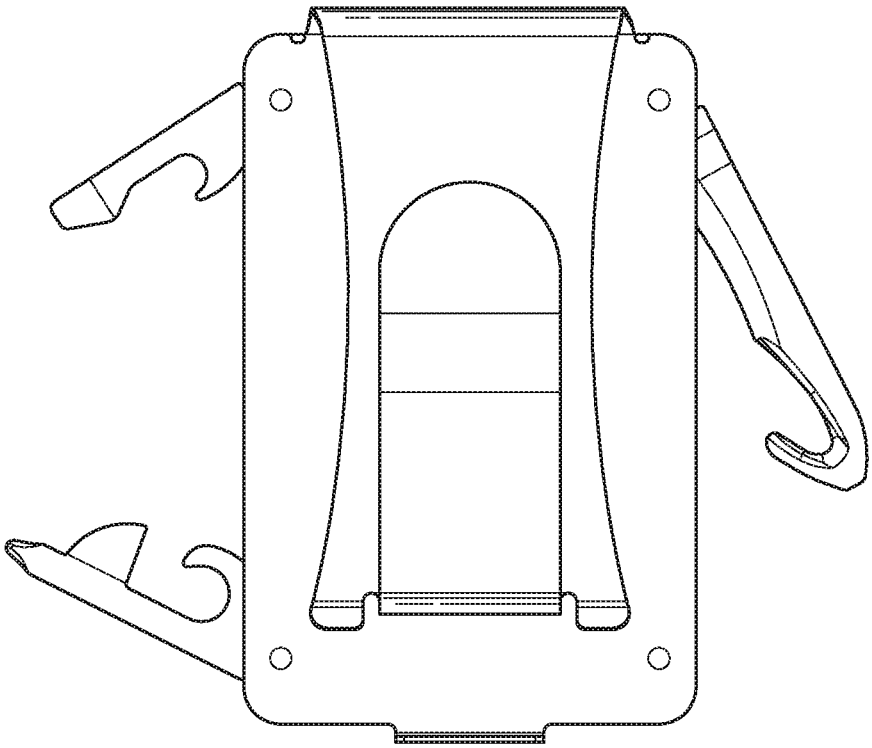
FIG. 6 shows a top view of the multi-tool money clip of FIG. 1 with the tools extended.
Figure 7:
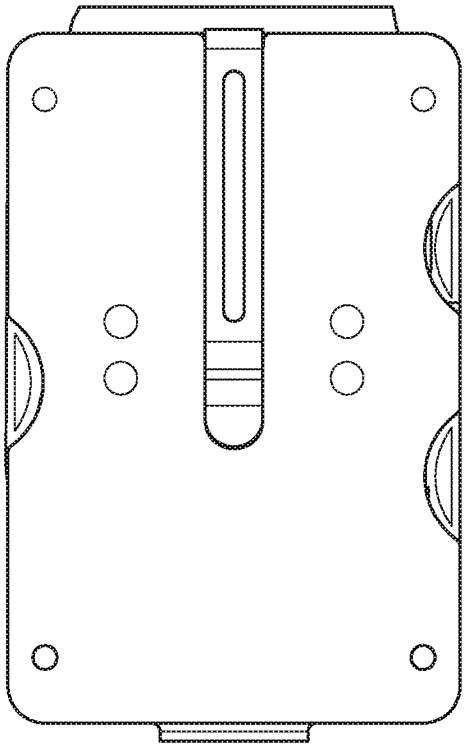
FIG. 7 shows a bottom view of the multi-tool money clip of FIG. 1.
Figure 8:
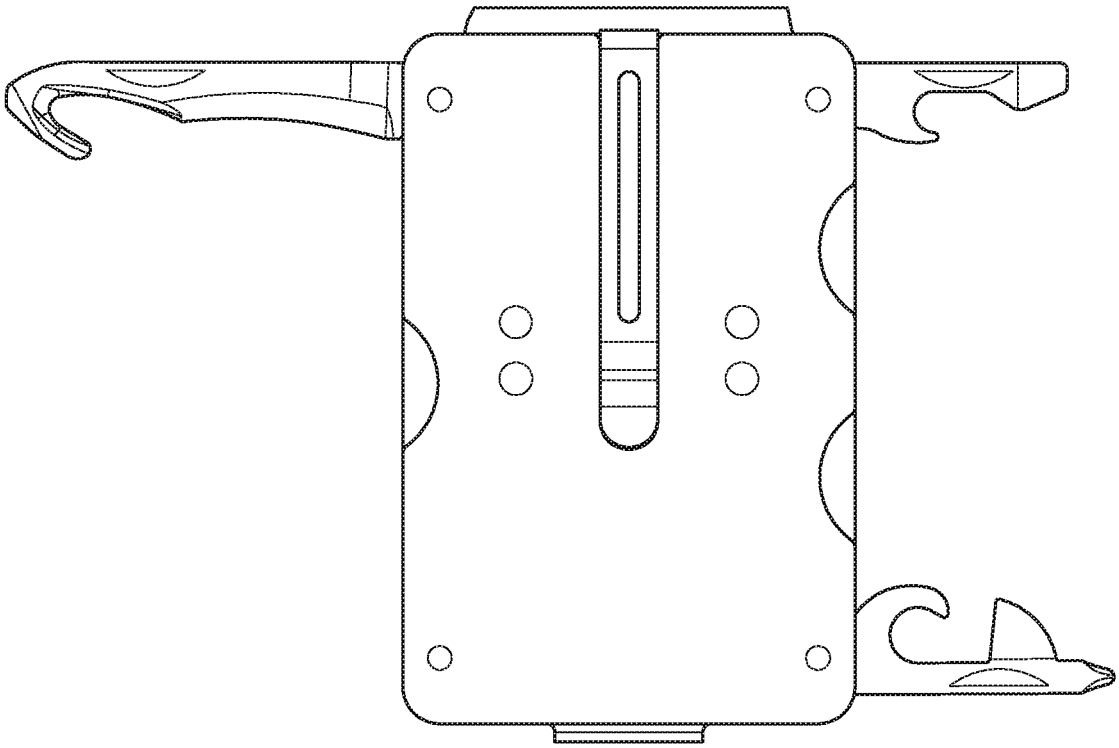
FIG. 8 shows a bottom view of the multi-tool money clip of FIG. 1 with the tools fully extended.
Figure 9:
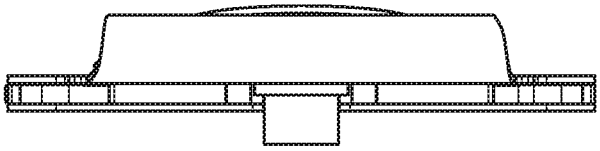
FIG. 9 shows a first end view of the multi-tool money clip of FIG. 1.
Figure 10:
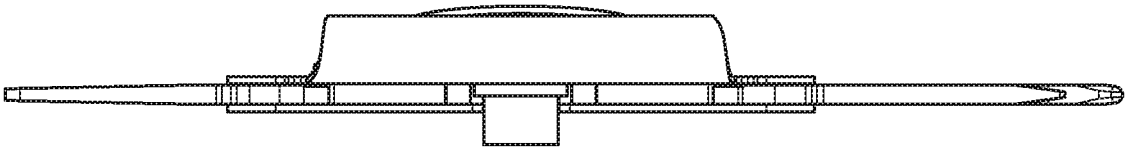
FIG. 10 shows a first end view of the multi-tool money clip of FIG. 1 with the tools partially extended.
Figure 11:
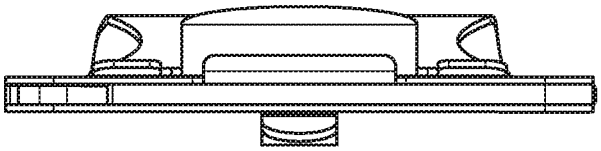
FIG. 11 shows a second end view of the multi-tool money clip of FIG. 1.
Figure 12:
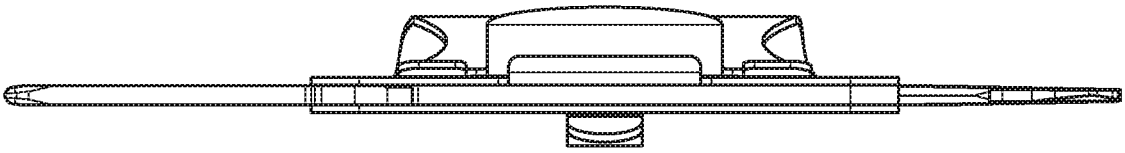
FIG. 12 shows a second end view of the multi-tool money clip of FIG. 1 with the tools extended.
Figure 13:
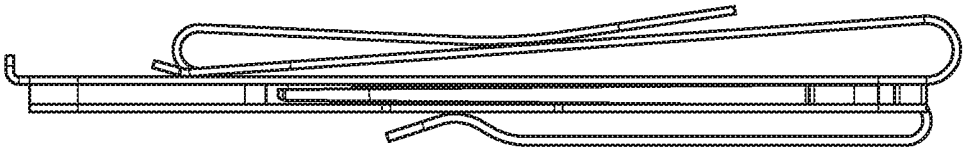
FIG. 13 shows a right side view of the multi-tool money clip of FIG. 1.
Figure 14:
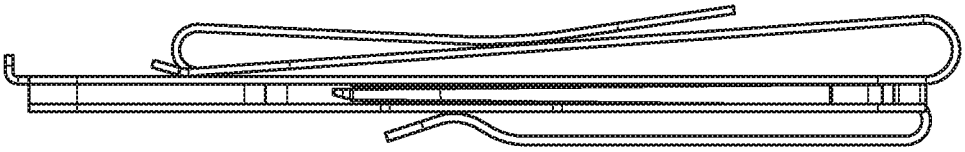
FIG. 14 shows a right side view of the multi-tool money clip of FIG. 1.
Figure 15:
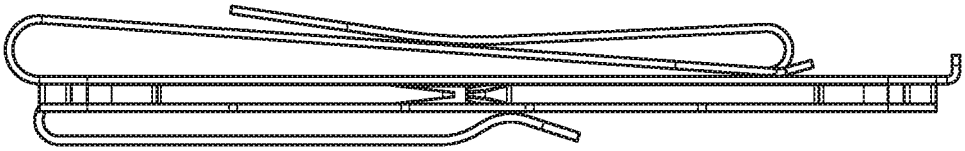
FIG. 15 shows a left side view of the multi-tool money clip of FIG. 1.
Figure 16:
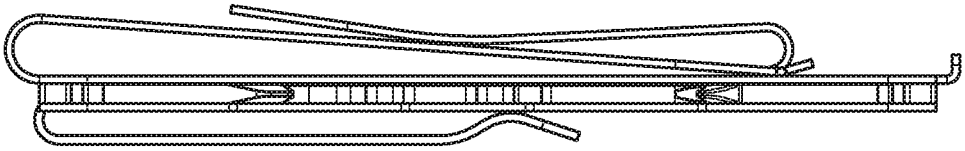
FIG. 16 shows a left side view of the multi-tool money clip of FIG. 1.

FIG. 4 shows a perspective bottom view of the multi-tool money clip of FIG. 1 with the tools partially extended. The tools extend a full 180 degrees when fully extended. FIG. 5 shows a top view of the multi-tool money clip of FIG. 1. FIG. 6 shows a top view of the multi-tool money clip of FIG. 1 with the tools extended. FIG. 7 shows a bottom view of the multi-tool money clip of FIG. 1. FIG. 8 shows a bottom view of the multi-tool money clip of FIG. 1 with the tools full extended. FIG. 9 shows a first end view of the multi-tool money clip of FIG. 1. FIG. 10 shows a first end view of the multi-tool money clip of FIG. 1 with the tools extended. FIG. 11 shows a second end view of the multi-tool money clip of FIG. 1. FIG. 12 shows a second end view of the multi-tool money clip of FIG. 1 with the tools extended. FIG. 13 shows a right side view of the multi-tool money clip of FIG. 1. FIG. 14 shows a right side view of the multi-tool money clip of FIG. 1. FIG. 15 shows a left side view of the multi-tool money clip of FIG. 1. FIG. 16 shows a left side view of the multi-tool money clip of FIG. 1.

Figure 17:
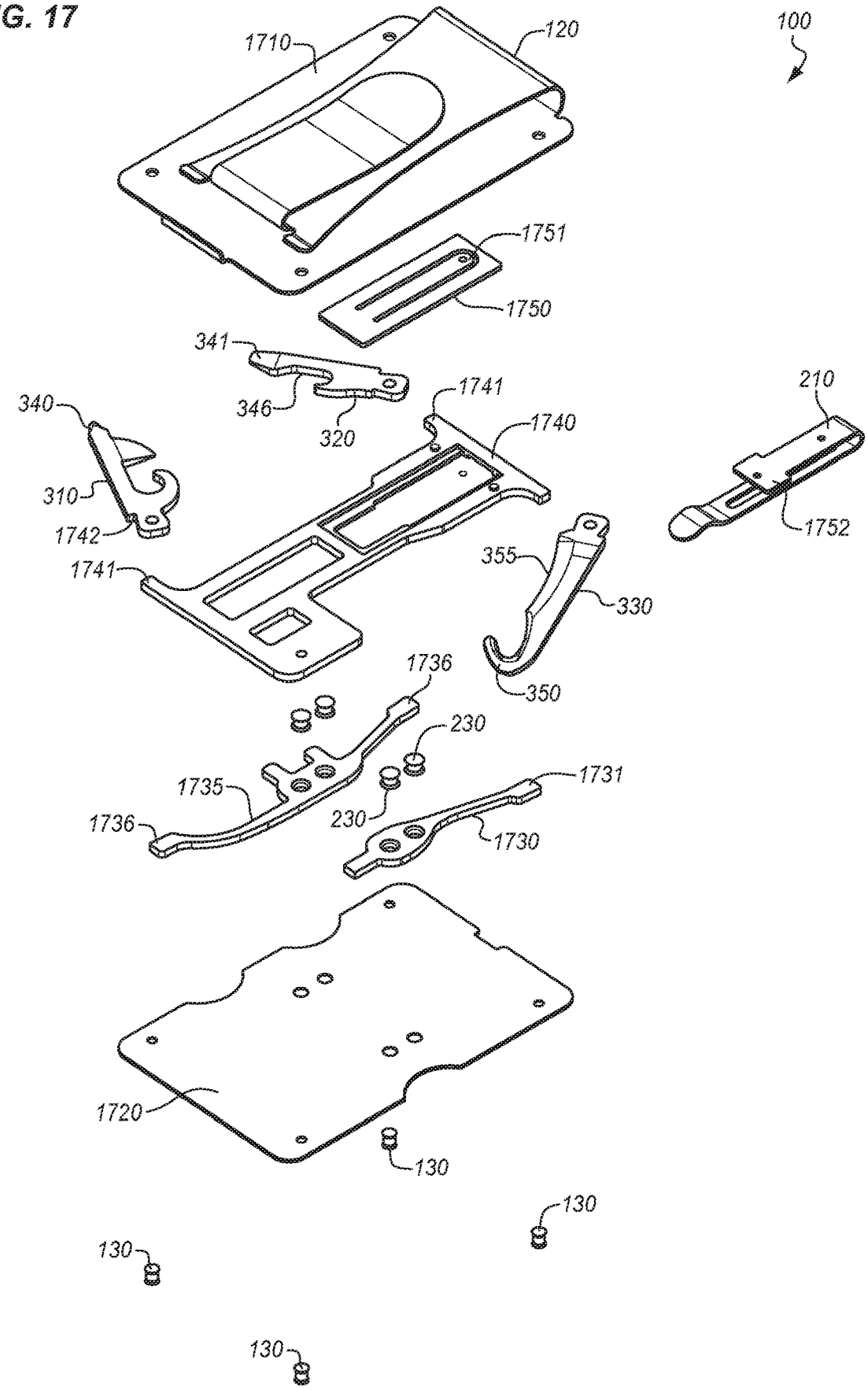
FIG. 17 shows an exploded view of the multi-tool money clip of FIG. 1.

FIG. 17 shows an exploded view of the multi-tool money clip. As shown, body 110 includes face 1710 which is attached to clip 120. The device also includes face 1720. Face 1710 and face 1720 are held together via rivets 130. The faces 1710, 1720, function to sandwich the tools between them and provide for a back to the multi-tool money clip 100. As shown, single spring 1730 and double spring 1735 are held in place by rivets 230. Single spring 1730 and double spring 1735 push against the tools at spring heads 1731, 1736.

Multi-tool money clip 100 includes a spacer or internal frame 1740. Spacer 1740 includes end stops 1741 that prevent the over-rotation of the various tools. Visible here are can opener 310, bottle opener 320, and box opener 330. These tools mount on the respective rivets 130 in the corners of the device. The notch 1742 on the back side of can opener 310 (and similarly on the other tools), interact with the end stops 1741 to prevent over-rotation. Additionally, the device includes pocket clip spacer 1750. Pocket clip spacer 1750 includes a slot 1751 for pocket clip 210 to slide in and extend from, where extension 1752 slides in the slot.

Multi-tool money clip 100 differs significantly from other multi-tools, for some of the following reasons. It provides for ultra-thin construction. Multi-tool money clip 100 provides for this while still offering three extendable tools. Other tools may offer 3 extendable tools, but typically two of the tools rotate around the same vertex, increasing the thickness of the tool. Additionally, multi-tool money clip 100 provides for a dual clip money clip that has a clip opening in one direction for holding money and cards and the other for attaching to an article of clothing or other item. Multi-tool money clip 100 includes extendable pocket clip 210 on the side opposite the money clip section While specific embodiments have been described in detail in the foregoing detailed description, it will be appreciated by those skilled in the art that various modifications and alternatives to those details could be developed in light of the overall teachings of the disclosure and the broad inventive concepts thereof. It is understood, therefore, that the scope of this disclosure is not limited to the particular examples and implementations disclosed herein but is intended to cover modifications within the spirit and scope thereof as defined by the appended claims and any and all equivalents thereof.

What is claimed as new and desired to be protected by Letters Patent of the United States is:

1. A multifunction money clip, comprising:

a thin plate body portion having an internal area defined between a first plate and a second plate;

a plurality of rotationally extendable tools, located in the internal area;

an internal frame located in the internal area between the first plate and the second plate;

a first clip located on a first side of the thin plate body portion, the first clip located such that the clip is configured to trap items between the first side of the thin plate body portion and the first clip; and a second clip located on a second side of the thin plate body portion, the second clip located such that the clip is configured to trap items between the second side of the thin plate body portion and the second clip, the second clip slidably coupled to the internal frame and configured to selectively extend from the thin plate body portion to adjust an extension position of the second clip relative to the thin plate body portion; and a spacer coupled to the internal frame and adapted to slidably couple the second clip to the internal frame, the spacer located in the internal area between the first plate and the second plate, the spacer comprising a slot and the second clip comprising an extension adapted to slide in the slot to adjust the extension position of the second clip relative to the thin plate body portion.

2. The multifunction money clip of claim 1, wherein the first clip includes a double clip, a first portion of the double clip opening in a first direction and a second portion of the double clip opening in a second direction, opposite the first direction, and configured to trap items between the second clip portion and the first clip portion.

3. The multifunction money clip of claim 2, wherein the first portion of the double clip is located nearer to the thin plate body portion than the second portion of the double clip.

4. The multifunction money clip of claim 3, wherein the first portion of the double clip has upturned ends forming an incline for the insertion items.

5. The multifunction money clip of claim 4, wherein:

the first clip is connected to a top of the thin plate body portion; and the second clip is connected to and extendable from the top of the thin plate body portion.

6. The multifunction money clip of claim 5, wherein the plurality of rotationally extendable tools includes a box opener tool, a can opener tool, and a bottle opener tool.

7. The multifunction money clip of claim 6, wherein the can opener tool includes a narrowed Philips head screw driver at an end.

8. The multifunction money clip of claim 7, wherein the bottle opener tool includes a narrowed flat head screw driver at an end.

9. The multifunction money clip of claim 6, wherein the can opener tool and the bottle opener tool are on a first widthwise side of the thin plate body portion and the box opener tool is on a second widthwise side of the thin plate body portion.

10. The multifunction money clip of claim 9, wherein the thin plate body portion is between 2 and 5 millimeters thick.

11. The multifunction money clip of claim 10, wherein the plurality of rotationally extendable tools are each connected to the thin plate body portion via one of a plurality of pivot points.

12. The multifunction money clip of claim 11, wherein the plurality of pivot points hold the first plate and the second plate of the thin plate body portion together and the plurality of pivot points are located proximate to the corners of the thin plate body portion.

13. The multifunction money clip of claim 1, wherein the spacer is oriented in an aperture in the internal frame.

14. The multifunction money clip of claim 1, wherein the internal frame includes a stop for preventing the over-rotation of at least one of the plurality of rotationally extendable tools.

15. The multifunction money clip of claim 14, further comprising a double spring, the double spring oriented in the internal area such that the double spring interacts with at least two of the plurality of rotationally extendable tools, preventing the at least two of the plurality of rotationally extendable tools from extending.

16. The multifunction money clip of claim 14, wherein at least one tool of the plurality of rotationally extendable tools includes a hooked end and a notch positioned and configured to rest against the stop when the at least one tool is extended.

17. The multifunction money clip of claim 1, wherein the first clip defines one of the first plate or the second plate.

18. A multifunction money clip comprising:

a first plate;

a second plate connected to the first plate via a plurality of connectors at the corners of the first and second plate, the first plate and the second plate forming an internal area;

an internal frame positioned within the internal area between the first plate and the second plate;

a spacer positioned within a portion of the internal frame to slidably couple a pocket clip to the internal frame, the spacer located in the internal area between the first plate and the second plate, wherein a slot is disposed in the spacer;

a plurality of tools each rotationally connected to the first and second plate via one of the plurality of connectors, the plurality of tools located in the internal area when retracted;

a double clip located on the first plate, a first portion of the double clip opening in a first direction and configured to trap items between the first plate and the clip and a second portion of the double clip opening in a second direction, opposite the first direction, and configured to trap items between the second clip portion and the first clip portion; and the pocket clip located on the second plate, the pocket clip slidably coupled to the internal frame via the spacer to selectively extend the pocket clip from the second plate, the pocket clip comprising an extension sliding in the slot of the spacer to adjust an extension position of the pocket clip relative to the second plate.

19. The multifunction money clip of claim 18, wherein the plurality of tools includes a box opener tool, a can opener tool, and a bottle opener tool.

20. A method of using a multifunction money clip, comprising:

providing a multifunction money clip including a first plate;

a second plate connected to the first plate via a plurality of connectors at the corners of the first and second plate, the first plate and the second plate forming an internal area;

an internal frame positioned within the internal area between the first plate and the second plate;

a spacer positioned within a portion of the internal frame to slidably couple a pocket clip to the internal frame, the spacer located in the internal area between the first plate and the second plate, wherein a slot is disposed in the spacer;

a plurality of tools each rotationally connected to the first and second plate via one of the plurality of connectors, the plurality of tools located in the internal area when retracted;

a double clip located on the first plate, a first portion of the double clip opening in a first direction and configured to trap items between the first plate and the clip and a second portion of the double clip opening in a second direction, opposite the first direction, and configured to trap items between the second clip portion and the first clip portion; and the pocket clip located on the second plate, the pocket clip slidably coupled to the internal frame via the spacer to selectively extend the pocket clip from the second plate, the pocket clip comprising an extension sliding in the slot of the spacer to adjust an extension position of the pocket clip relative to the second plate;

placing at least one item selected from a card and money in the first portion of the double clip;

attaching the multifunction money clip to an article of clothing using the pocket clip attached to the second plate;

detaching the multifunction money clip from the article of clothing; and extending at least one of the plurality of tools from the multifunction money clip.

* * * * *